United States Patent [19]

Ochi

[11] 3,940,138

[45] Feb. 24, 1976

[54] RACING GAME DEVICE

[75] Inventor: Shikanosuke Ochi, Tokyo, Japan

[73] Assignee: Kabushiki Kaisha Sega Enterprises, Tokyo, Japan

[22] Filed: Nov. 19, 1974

[21] Appl. No.: 525,280

[30] Foreign Application Priority Data

Sept. 6, 1974 Japan ..... 49-101908

[52] U.S. Cl. ..... 273/86 B; 46/240

[51] Int. Cl.[2] ..... A63F 9/14

[58] Field of Search ..... 273/86 B, 1 M; 46/240

[56] References Cited

UNITED STATES PATENTS

| | | | |
|---|---|---|---|
| 2,441,060 | 5/1948 | Cunningham | 273/86 B |
| 2,918,284 | 12/1959 | Baca | 273/86 B |
| 3,103,360 | 9/1963 | Miller et al. | 273/86 B |
| 3,532,341 | 10/1970 | Shaw | 273/86 B |

FOREIGN PATENTS OR APPLICATIONS

| | | | |
|---|---|---|---|
| 809,539 | 4/1969 | Canada | 273/86 B |

*Primary Examiner*—Anton O. Oechsle

*Attorney, Agent, or Firm*—Wenderoth, Lind & Ponack

[57] ABSTRACT

A racing game device simulating horse racing, auto racing, etc. has guide members, a travelling base frame which can travel along a predetermined locus established by the guide members, a plurality of movable models disposed on the travelling base frame in such manner that they may be reciprocated freely and individually along the locus, and drive mechanisms for individually driving the respective movable models.

6 Claims, 9 Drawing Figures

RACING GAME DEVICE

BACKGROUND OF THE INVENTION

This invention relates to a racing game device which simulates horse racing, auto racing, etc.

Heretofore, a great many racing game devices have been known in which a plurality of racing car models, for example, are made to travel along an annular racing course to vie in order of arrival at a goal.

In some of these racing game devices, at an extremity of a rotary arm that is rotatable about a fixed point are mounted a plurality of models in a concentric manner so as to be freely rotated, and said rotary arm and said plurality of models are respectively rotated. However, in such type of racing game devices, since the movements of said models involve a regularity, participant interest was largely reduced.

SUMMARY OF THE INVENTION

Therefore, it is a principal object of the present invention to provide an improved racing game device that is free from the aforementioned disadvantages in the prior art.

A more specific object of the present invention is to provide an improved racing game device in which it cannot be anticipated at all which one of a plurality of movable models may first arrive at a goal whereby participant interest can be enhanced.

According to one feature of the present invention, there is provided a racing game device characterized in that said device comprises guide members, a travelling base frame which can travel along a predetermined locus established by said guide members, a plurality of movable models disposed on said travelling base frame in such manner that they may be reciprocated freely and individually along said locus, and drive means for driving said respective movable models.

In the racing game device according to the present invention, as described above, since said device is composed of guide members, a travelling base frame which can travel along a predetermined locus established by said guide members, a plurality of movable models disposed on said travelling base frame in such manner that they may be reciprocated freely and individually along said locus, and drive means for driving said respective movable models, if said travelling base frame is started towards a goal while said drive means is started after said movable models are aligned along a start line, then said plurality of movable models can travel along said predetermined locus while individually varying their speeds relative to each other during a period of time.

In addition, according to the present invention, by appropriately changing the timing of the operation of said drive means, the stroke of the reciprocating motion on said travelling base frame as well as the timing for switching the reciprocating motion can be arbitrarily varied, and consequently the interest of the participants can be maintained.

DETAILED DESCRIPTION OF A PREFERRED EMBODIMENT

Now the present invention will be described in more detail in connection to a preferred embodiment thereof illustrated in the accompanying drawings.

Figure 1:
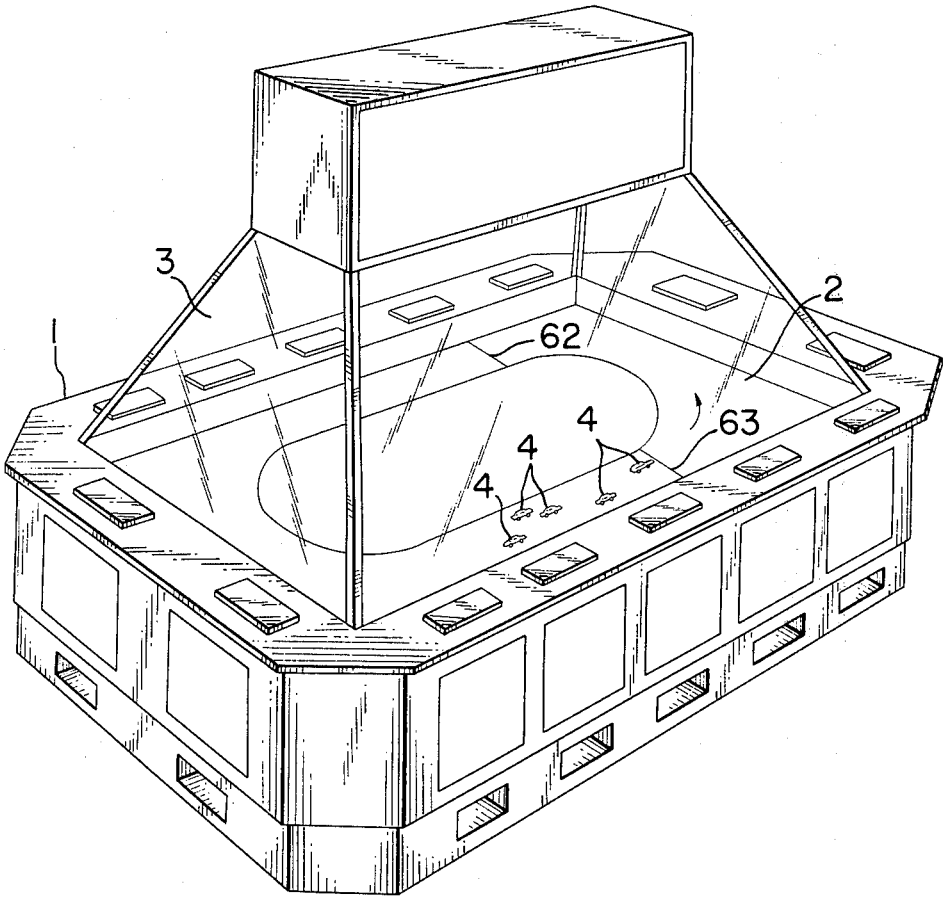
FIG. 1 is a perspective view showing one preferred embodiment of racing game device according to the present invention.
Figure 2:
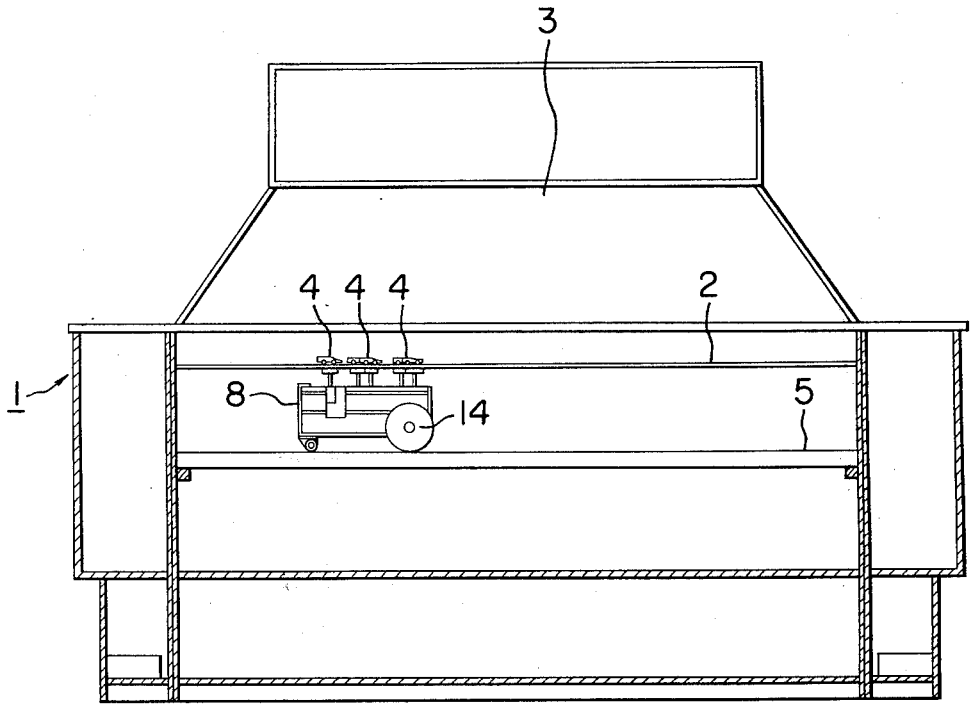
FIG. 2 is a longitudinal cross-section side view of the same.
Figure 3:
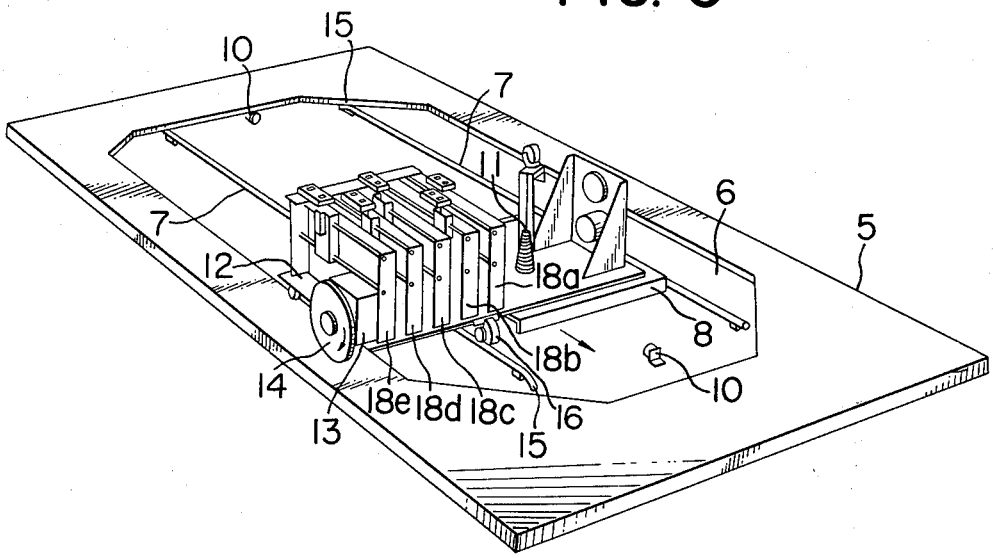
FIGS. 3 and 4 are perspective views of an essential part of the same device.
Figure 4:
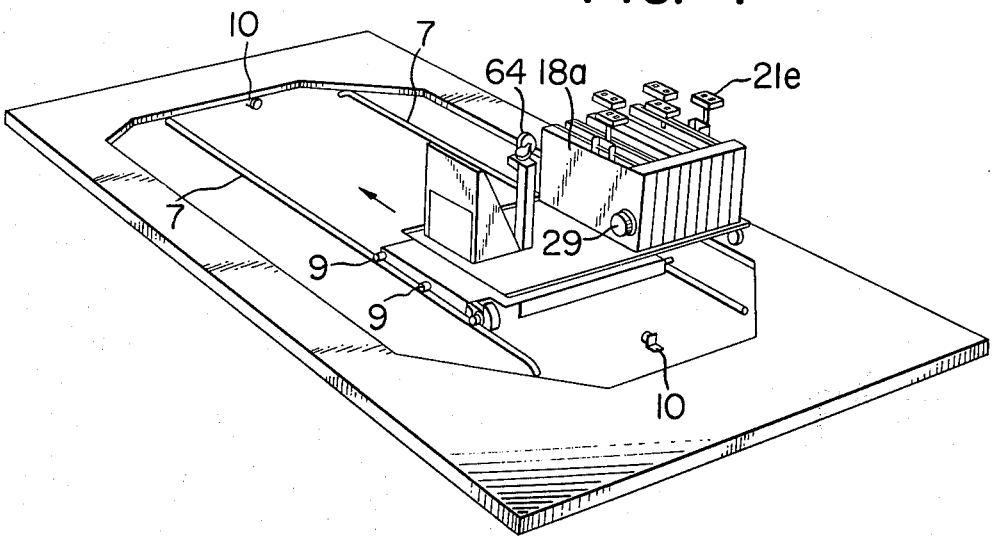

Referring to FIG. 1, reference numeral (1) designates a cabinet having a generally rectangular shape with its four corners obliquely cut away. On the top surface of the cabinet 1 is a horizontally extending opaque non-magnetic racing course plate 2 having tracks painted thereon. Transparent plates 3 are disposed above the racing course plate in a truncated rectangular pyramid shape, and five models 4 are placed on said racing course plate 2. The models are shown as autos, but they may be horses or other models of things which are raced on a race course.

Throughout the specification and drawings five similar members such as the five auto models 4 are described and illustrated. For convenience of explanation, these five similar members are generally designated by a given reference numeral, while the individual members among these five members are identified by reference numerals plus suffix *a*, *b*, *c*, *d* and *e*. For instance, the respective ones of the above-described auto models 4 are individually identified by reference numerals 4*a*, 4*b*, 4*c*, 4*d* and 4*e*. It is equally true for movable pieces 21*a*, 21*b*, 21*c*, 21*d* and 21*e*, model driving motors 29*a*, 29*b*, 29*c*, 29*d* and 29*e*, etc.

Within said cabinet 1 as seen in FIGS. 2–6 is a horizontally extending support table 5, in a central recessed portion 6 of which are laid two rails 7 parallel to each other, and a travelling base frame 8 is adapted to be capable of reciprocating forth and back until it strikes against stops 10 at the front and rear ends, of said recessed portion respectively, while it is supported on said rails 7 via rollers 9.

In addition, at the center of said travelling base frame 8 is a pivotal shaft 11 directed vertically upwards, a rotatable table 12 being pivotably mounted on said shaft 11, and a driving wheel 14 which is driven by a travelling motor 13 is mounted at the extremity of the rotatable table 12.

The diagonally opposite ends 15 of said two rails 7 are bent downwardly, and at the corresponding diagonally opposite corners of said travelling base table 8 are pivotably supported hooks 16 which are detachably engageable with the rotatable table 12. On the hook 16 is pivotably mounted a roller 17 which can roll along said rail 7, and when said travelling motor 13 is driven, if said travelling base frame 8 is positioned in the middle portion of the rails 7, then the hook 16 is engaged with the rotatable table 12, so that the travelling base frame 8 can travel along said rails 7 while it is integrally coupled to the rotatable table 12 due to the torque of the driving wheel 14. When the travelling base frame 8 strikes against the stops 10 and is stopped thereby, the hook 16 which has been in engagement with the rotatable table 12 is displaced downwardly at the bent portion 15 of the rail 7 and is disengaged from the rotatable table 12, so that while the travelling base frame 8 is kept stopped by the stop 10, the rotatable table 12 is turned 180° about the pivotal shaft 11 due to the torque of the driving wheel 14 running in frictional engagement with the support table 5 until the rotatable table 12 is engaged with the other hook on the opposite side of the traveling base frame 8 from the first-mentioned hook 16, so that the rotatable table 12 begins to return in the opposite direction along the rails 7 while it is integrally coupled with the travelling base frame 8.

Figure 5:
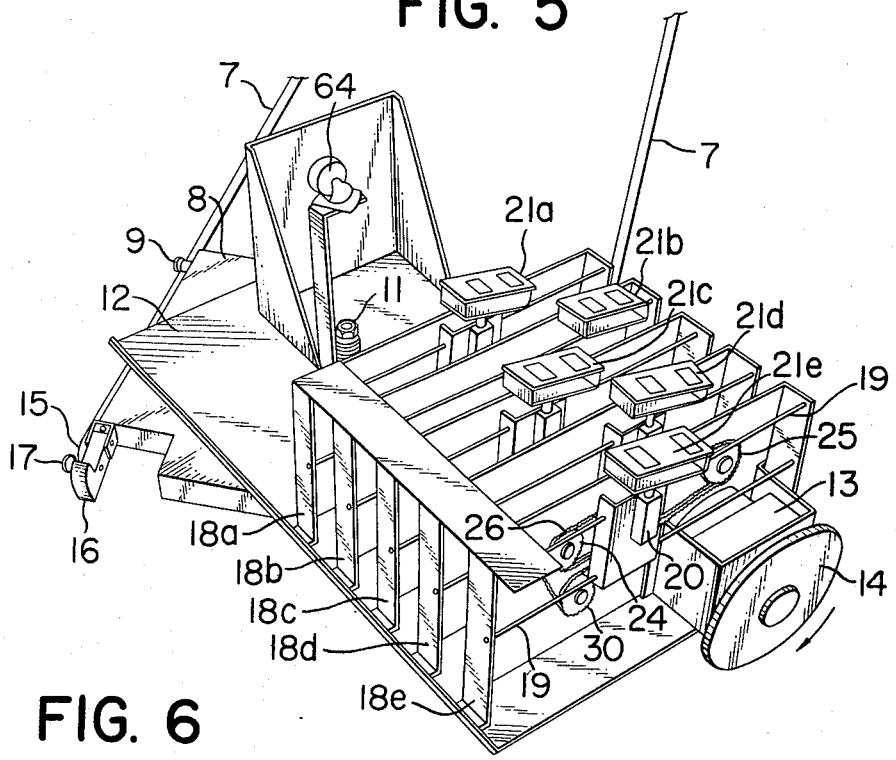
FIG. 5 is an enlarged perspective view of an essential part of the part of the device shown in FIGS. 3 and 4.
Figure 6:
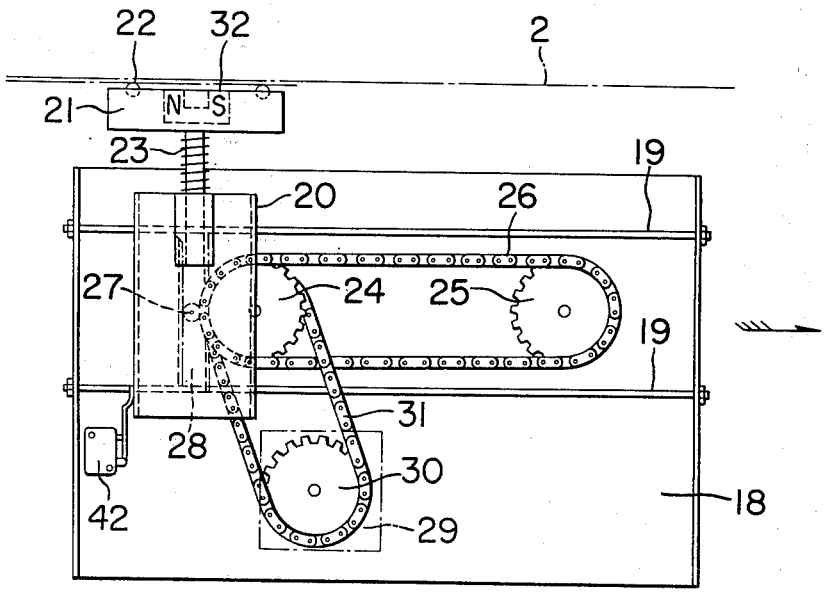
FIG. 6 is a longitudinal cross-section side view of the part shown in FIG. 5.

As illustrated in more detail in FIGS. 5 and 6, five brackets 18*a*, 18*b*, . . . 18*e* are integrally mounted on the rotatable table 12, the brackets 18*a*, 18*b*, . . . 18*e* are respectively provided with two guide rails 19 extending horizontally over their entire length, movable frames 20*a*, 20*b*, . . . 20*e* are slidably fitted on the rails 19 of the respective brackets, on the movable frames 20*a*, 20*b*, . . . 20*e* are mounted movable pieces 21*a*, 21*b*, . . . 21*e*, respectively, in a manner such that they can be freely raised or lowered, and wheels 22 are rotatably mounted on the top surface of the movable pieces 21*a*, 21*b*, . . . 21*e*, the respective wheels 22 being adapted to be always brought in pressing contact with the lower surface of the racing course plate 2 by means of resilient forces of compression springs 23 inserted between the movable frames 20*a*, 20*b*, . . . 20*e* and the movable pieces 21*a*, 21*b*, . . . 21*e*, respectively.

In addition, on the respective brackets 19*a*, 19*b*, . . . 19*e* are pivotably mounted two chain sprockets 24 and 25 spaced a predetermined distance from each other, and around the sprockets 24 and 25 is stretched an endless chain 26. A pin 27 projecting from one position on the chain 27 is loosely fitted in a vertical groove 28 in the movable frame 20, and another endless chain 31 is stretched around the aforementioned one sprocket 24 and a sprocket 30 of a model driving motor 29, so that when the model driving motor 29 is driven in one direction, the movable frame 20 is reciprocated in the lengthwise direction of the bracket 18 via the pin 27 projecting from the chain 26.

At the bottom of the auto models 4 and at the top of the movable pieces 21 are mounted magnets 32 (only the movable piece 21 being shown in FIG. 6), so that the auto models 4 are adapted to move on the racing course plate 2 in response to the movements of the movable pieces 21, being magnetically attracted by the movable pieces 21 with the racing course plate 2 interposed therebetween.

At the top of the pivotal shaft 11 is rotatably mounted a racing course plate supporting roller 64 in such manner that it may be also freely rotated about a vertical axis, and so, the weight of the auto models 4 on the racing course plate 2 is borne by the pivotal shaft 11 to prevent deformation of the racing course plate 2.

Now a control circuit for the above-described embodiment of the invention will be described with reference to FIGS. 7, 8 and 9.

Figure 7:
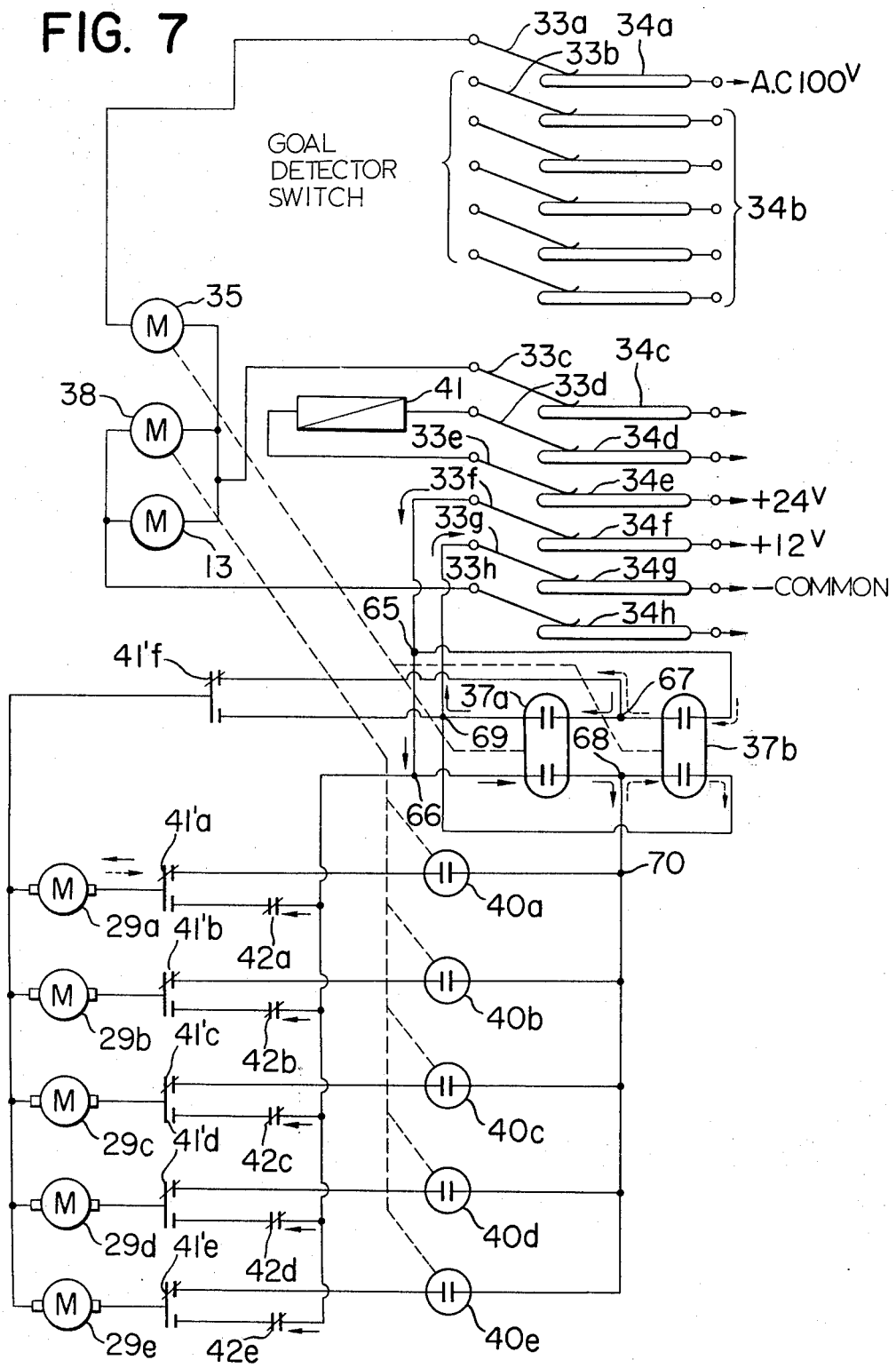
FIG. 7 is a control circuit diagram for the travelling base frame in this particular embodiment.
Figure 8:
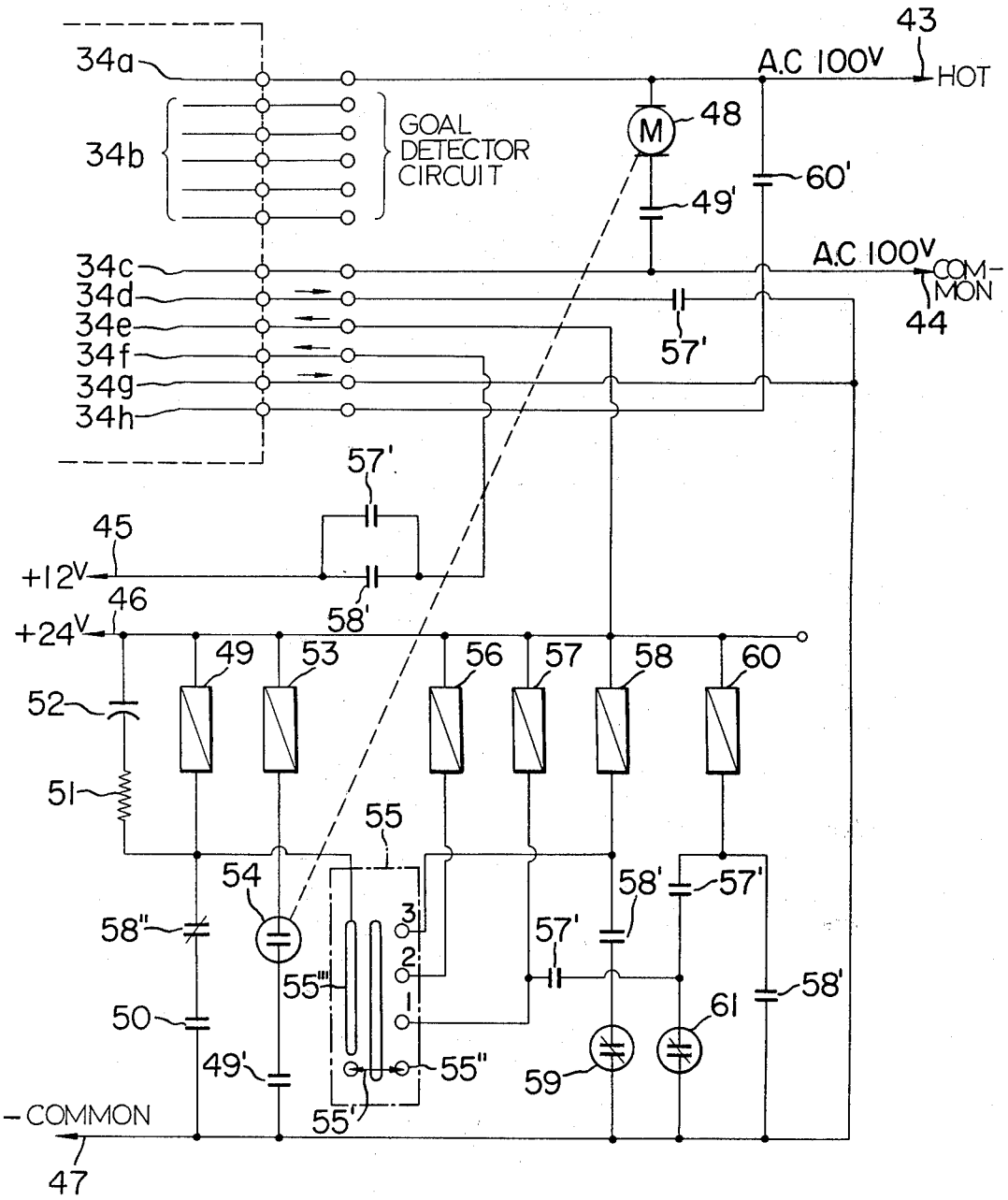
FIG. 8 is a control circuit diagram for the cabinet in the same embodiment.

FIG. 7 is a circuit diagram of a control circuit provided on the travelling base frame 8, while FIG. 8 is a circuit diagram of a control circuit provided in the cabinet 1, and these two control circuits are electrically connected to each other through trolleys 33 and trolley wires 34.

Figure 9:
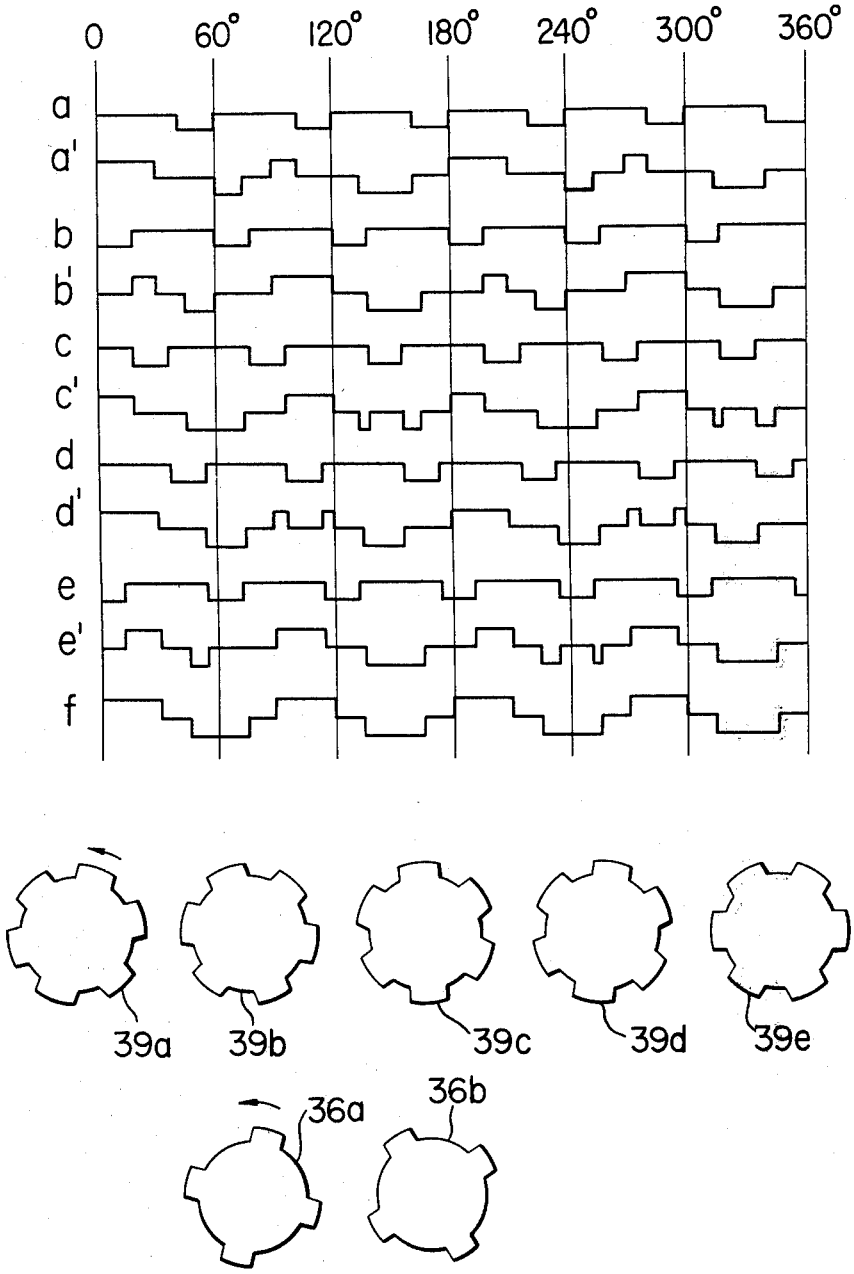
FIG. 9 is a diagrammatic view showing a timing diagram, which represents ON and OFF states (*a*, *b*, *c*, *d* and *e*) and current waveforms (*a'*, *b'*, *c'*, *d'*, *e'* and *f*) of cam switches in the upper portion, and profiles and directions of rotation of the respective cams for said cam switches in the lower portion.

Reference numeral 35 designates an alternating cam motor which is provided with two alternating cams 36*a* and 36*b* as shown in the lower portion of FIG. 9, and adjacent to the alternating cams 36*a* and 36*b* are disposed alternating cam switches 37*a* and 37*b*, respectively. When the alternating cam motor 35 is driven in rotation, the alternating cam switches 37*a* and 37*b* are adapted to generate a current waveform flowing through the model driving motors 29 as shown at *f* in the upper portion of FIG. 9. In this waveform, in the period when it is at an upper level, the alternating cam switch 37*a* is closed to cause a current flow in the direction shown by solid line arrows in FIG. 7, while in the period when it is at a lower level, the alternating cam switch 37*b* is closed to cause a current flow in the direction shown by dashed line arrows in FIG. 7, and in the period when it is at a middle level, neither the alternating cam switch 37*a* nor cam switch 37*b* is closed.

A pulse cam motor 38 is connected in parallel to the travelling motor 13, and pulse cams 39*a*, 39*b*, . . . 39*e* shown in the lower portion of FIG. 9 are directly connected to the pulse cam motor 38, pulse cam switches 40*a*, 40*b*, . . . 40*e* being disposed adjacent to the pulse cams 39*a*, 39*b*, . . . 39*e*. When the pulse cam motor 38 is driven in rotation, the pulse cam switches 40*a*, 40*b*, . . . 40*e* are opened and closed according to waveforms *a*, *b*, *c*, *d* and *e*, respectively, of the diagram shown in the upper portion of FIG. 9. In these waveform diagrams, a higher level represents the state where the pulse cam switches 40*a*, 40*b*, . . . 40*e* are closed, while a lower level represents the state where they are opened.

Relay contacts 41′*a*, 41′*b*, . . . 41′*e* of a reset relay 41 are disposed in a power supply circuit for the driving motors 29*a*, 29*b*, . . . 29*e*. If the reset relay 41 is not actuated, then the model driving motors 29*a*, 29*b*, . . . 29*e* are respectively connected to the pulse cam switches 40*a*, 40*b*, . . . 40*e* in series, whereas if the reset relay 41 is operated, then the model driving motors 29*a*, 29*b*, . . . 29*e* are respectively connected to the model start position switches 42*a*, 42*b*, . . . 42*e* in series. These model start position switches 42 are illustrated as micro-switches mounted on the respective brackets in FIG. 6, and also in FIG. 7 are shown their switch contacts (break contact) 42*a*, 42*b*, . . . 42*e* only. In addition, relay contact 41′*f* of the reset relay 41 is interposed between the driving motors 29*a*, 29*b*, . . . 29*e* and the circuitry of the alternating cam switches 37*a* and 37*b*.

One power supply terminal of the alternating cam motor 35 is connected to one terminal (ungrounded terminal) 43 of an A.C. 100V power supply via a trolley 33*a* and a trolley wire 34*a*, and the other power supply terminal of the alternating cam motor 35 is connected to the other terminal (common terminal) 44 of the A.C. 100V power supply via a trolley 33*c* and a trolley wire 34*c*, and therefore, when a power supply plug socket (not shown) for the cabinet 1 is plugged into an A.C. power supply, the alternating cam motor 35 is continuously driven in rotation.

Goal detector switches (not shown) of the respective auto models 4*a*, 4*b*, . . . 4*e* which correspond to the movable pieces 21*a*, 21*b*, . . . 21*e*, respectively, are electrically connected to a goal detector circuit (not shown) via trolleys 33*b* and trolley wires 34*b*, so that as will be described in more detail later, arrival of the five auto models 4*a*, 4*b*, . . . 4*e* at a goal can be detected by the goal detector switches and the detected signals are transmitted to the goal detector circuit.

One terminal of the reset relay 41 is connected through a trolley 33*d*, a trolley wire 34*d*, and a make contact 57' of a waiting relay 57, to a D.C. common terminal 47, and the other terminal of the reset relay 41 is connected through a trolley 33*e* and a trolley wire 34*e* to a positive terminal 46 of a D.C. 24V power source.

A trolley 33*f* and a trolley wire 34*f* are connected through a parallel connection of a make contact 58' of a running relay 58 and a make contact 57' of the waiting relay 57 to a positive terminal 45 of a D.C. 12V power supply, a trolley 33*g* and a trolley wire 34*g* are connected to a negative common terminal of a D.C. power supply, and a trolley 33*h* and a trolley wire 34*h* are connected through a make contact 60' of a travelling relay 60 to one terminal (ungrounded terminal) 43 of the A.C. 100V power supply.

In the control circuit on the cabinet side illustrated in FIG. 8, between one terminal 43 and the other terminal 44 of the A.C. 100V power supply is series connected a timing motor 48 and a make contact 49' of a holding relay 49.

In an actuation circuit for the holding relay 49 are series connected a coin switch 50 that is kept closed for a predetermined period of time after a coin has been thrown in, and a break contact 58'' of the running relay 58, and in parallel to the holding relay 49 are connected a resistor 51 and a capacitor 52 for locking the holding relay 49 with time delay for a predetermined period.

Further, in an actuation circuit for a control stepping coil 53 are series connected a timing cam switch 54 that is mechanically directly connected to the timing motor 48 and a make contact 49' of the waiting relay 49 in series. Thus if the holding relay 49 is actuated and the timing motor 48 is driven, then the timing cam switch 54 is intermittently closed, so that the control stepping coil 53 is actuated at a predetermined time interval (for instance, about every two seconds) to make a slider 55' of a control stepping disc step one increment each time.

In the aforementioned control stepping disc 55, when the slider 55' that is permanently connected to a common D.C. negative terminal 47 is located at a home position 55'', the slider 55' is not connected to a slide contact piece 55''' that is connected to the actuation circuit of the holding relay 49. However, during the period when the slider 55' is made to slide one step in response to actuation of the control stepping coil 53, the slider 55' is immediately connected to the slide contact piece 55'''. In addition, when the slider 55' has been stepped to the first step, the slider 55' is connected to an actuation circuit of the waiting relay 57. Subsequently, when it is stepped to the second step, it is connected to an actuation circuit of the buzzer relay 56; when stepped to the third step, it is connected to a running relay 58; and after four stepping operations (total required time being about 10 seconds) the slider 55' is again restored to its home position 55''.

In the actuation circuit of the waiting relay 57, a series connection of a self-holding make contact 57' and a start line switch 61 is connected in parallel to the first step of the control stepping disc 55, and in the actuation circuit of the running relay 58, a series connection of a self-holding make contact 58' and a goal line switch 59 is connected in parallel to the third step of the control stepping disc 55. Still further, in the actuation circuit of the travelling relay 60 are connected a waiting relay make contact 57' and a running relay make contact 58' as shown in FIG. 8.

While the goal line switch 59 and the start line switch 61 are shown in FIG. 8 merely as break contacts, practically they are micro-switches mounted at appropriate positions just under the goal line 63 and the start line 62, respectively, so that the micro-switches 59 and 61 may be actuated respectively when an auto model first arrives at the goal line 63, and when all the auto models 4 have been aligned on the start line 62.

Since the illustrated embodiment is constructed as described above, in the initial state when the travelling base frame 8 is located just under the goal line 63, the movable frames 20*a*, 20*b*, . . . 20*e* are positioned at arbitrary positions on the brackets 18*a*, 18*b*, . . . 18*e* shown in FIG. 6, and the auto models 4*a*, 4*b*, . . . 4*e* are stopped at random positions on or near the goal line 63 with only the auto model which has first arrived positioned on the goal line 63. Then if a coin (not shown) is inserted into the racing game device, then the coin switch 50 in FIG. 8 is closed and the holding relay 49 is actuated. Thereafter, even if the coin switch 50 is opened, the holding relay 49 is locked for a predetermined period of time by the self-holding delay circuit 51 and 52, and during that period of time, make contacts 49' of the holding relay 49 in the actuation circuit of the control stepping coil 53 and in the power supply circuit for the timing motor 48 are respectively closed, so that the control stepping coil 53 is intermittently energized by the operation of the timing motor 48, the control stepping disc 55 being stepped step-by-step, and the holding relay 49 is locked until the third step is finished.

When the control stepping disc 55 is stepped from its home position to its first step, the waiting relay 57 is actuated because a direct actuation circuit of the waiting relay 57 is closed. Then, the make contact 57' of the waiting relay 57 connected to the trolley wire 34*d* is closed, and so the reset relay 41 is actuated. Furthermore, since the waiting relay make contact 57' connected to the trolley wire 34*f* is closed, a D.C. current flows from a positive terminal 45 of a D.C. 12V power supply through the waiting relay make contact 57', trolley wire 34*f*, trolley 33*f*, model start position switches 42*a*, 42*b*, . . . 42*e*, reset relay make contacts 41'*a*, 41'*b*, . . . 41'*e*, model driving motors 29*a*, 29*b*, . . . 29*e*, reset relay make contact 41'*f*, junction point 69, trolley 33*g* and trolley wire 34*g* to the common negative terminal 47 of the D.C. power supply. Accordingly, the model driving motors 29*a*, 29*b*, . . . 29*e* are simultaneously rotated in the positive direction until all the movable frames 20*a*, 20*b*, . . . 20*e* are driven to the rearmost position on the brackets 18*a*, 18*b*, . . . 18*e*, where the movable frames 20*a*, 20*b*, . . . 20*e* are stopped respectively in response to closure of the model start position switches 42*a*, 42*b*, . . . 42*e*.

Simultaneously with starting of the positive rotation of the model driving motors 29*a*, 29*b*, . . . 29*e*, the travelling relay 60 is actuated by the closure of the waiting relay make contact 57' in the actuation circuit of the travelling relay 60, so that the travelling relay make contact 60' interposed between one terminal 43 of the A.C. 100V power supply and the trolley wire 34*h* is closed. Thus a circuit is completed from one terminal 43 of the A.C. 100V power supply, through the travelling relay make contact 60', trolley wire 34*h*, trolley 33*h*, running motor 13 and pulse cam motor 38 connected in parallel to each other, trolley 33*c* and trolley wire 34*c* to the other terminal 44 of the A.C. 100V power supply. As a result, the running motor 13 and the pulse cam motor 38 are driven, so that the driving wheel 14 is rotated by the driving of the running motor 13 to turn the rotatable table 12 180° about the pivotal shaft 11 while the travelling base frame 8 is kept stopped at the extreme position on the goal-start side as seen in FIG. 1, and when the rotatable table 12 has come just under the start line 62, the start line switch 61 is opened, which denergizes the travelling relay 60. The running motor 13 as well as the pulse cam motor 38 are stopped, and so, the rotatable table 12 is also stopped at that position. The waiting relay 57 is also denergized because its locking circuit including the start line switch 61 is interrupted.

Since the time required for the rotatable table 12 to arrive at the position just under the start line 62 starting from the position just under the goal line 63 is a few seconds, when the slider 55' of the control stepping disc 55 is stepped to the second step to actuate the buzzer relay 56 and a buzzer not shown is sounding, the auto models 4 have been already aligned on the start line 62, and thus the participants are informed by the buzzer that the auto models 4 are about to start.

After about two seconds has passed after the buzzer being to sound, the slider 55' of the stepping disc 55 is stepped by one step up to the third step, where the running relay 58 and the travelling relay 60 are both actuated, and the running relay 58 is locked until the goal line switch 59 is opened in response to arrival of the travelling base frame 8 at the goal line 63.

Owing to the actuation of the travelling relay 60, the travelling motor 13 and the pulse cam motor 38 are driven similarly to the above-described operation, and thereby the travelling base frame 8 is caused to travel towards the position just under the start line 62.

In this case, however, since the reset relay 41 is denergized, a D.C. current flows from one positive terminal 45 of the D.C. 12V power supply, through the running relay contact 58', trolley wire 34*f*, trolley 33*f*, junction point 65, and either one of the alternating cam switches 37*a* and 37*b*.

With reference to FIG. 9, if it is assumed here that the alternating cams 36*a* and 36*b* and the pulse cams 39*a*, 39*b*, . . . 39*e* are at the angular position of 0°, then the alternating cam switch 37*a* and the first pulse cam switch 40*a* [Explanation will be omitted for the second pulse cam 39*b* and the subsequent pulse cams.] are closed (See FIG. 9*a* and FIG. 9*f*). Accordingly, the D.C. current fed from the D.C. 12V power supply and passed through the trolley 33*f*, flows from the junction 66 rightwards in the horizontal direction (as viewed in FIG. 7) through the lower contact of the alternating cam switch 37*a*, junction points 68 and 70, the first pulse cam switch 40*a*, reset relay break contact 41'*a*, model driving motor 29*a*, reset relay break contact 41'*f*, junction point 67, upper contact of alternating cam switch 37*a*, junction point 69, trolley 33*g* and trolley wire 34*g*, to the common negative terminal 47 of the D.C. power supply. As a result, the first model driving motor 29*a*, and the third and fourth model driving motors 29*c* and 29*d* through which a D.C. current flows similarly to the first motor 29*a* (See FIG. 9*c'* and FIG. 9*d'*) rotate in the positive direction. Whereas, the second and fifth model driving motors 29*b* and 29*e* are kept stopped as seen from FIG. 9*b'* and FIG. 9*e'*, so that the first, third and fourth models 4*a*, 4*c* and 4*d* will and be advanced forwards with respect to the second and fifth models 4*b* and 4*e*.

As the alternating cams 36*a* and 36*b* and the pulse cams 39*a*, 39*b*, . . . 39*e* rotate, the current waveforms passed through the respective model driving motors 29*a*, 29*b*, . . . 29*e* become the waveforms as shown at *a'*, *b'*, *c'*, *d'*, *e'* in FIG. 9, which are derived by multiplying the values (1, 0, − 1) of the current waveform *f* produced by the alternating cam switches 37*a* and 37*b* by the value (1 or 0) of the current waveforms *a'*, *b'*, *c'*, *d'*, *e'* produced by the pulse cam switches 40*a*, 40*b*, . . . 40*e*. Consequently, the relative positions of the individual auto models 4*a*, 4*b*, . . . 4*e* with respect to each other, are determined by the algebraic sums of the positive and/or negative amount of rotation of the respective model driving motors 29*a*, 29*b*, . . . 29*e*, and they are varied from moment to moment as time passes.

After the aforementioned operations, when the slider 55' of the control stepping disc 55 has passed through the third step and has been restored to the original home position 55'', the holding relay 49 is denergized, but the running relay 58 and the travelling relay 60 are kept energized until the travelling base frame 8 arrives at the position just under the goal line 63, when the goal line switch 59 is opened, resulting in denergization of the running relay 58 and the travelling relay 60, and all the motors 13, 38, 29*a*, 29*b*, . . . 29*e* except for the alternating cam motor 35 are stopped, whereby the auto models 4*a*, 4*b*, . . . 4*e* are stopped in the proximity of the goal.

In the illustrated embodiment, although the alternating cam motor 35 is continuously rotating, the pulse cam motor 38 begins to rotate when the travelling relay contact 60' interposed between one terminal 43 of the A.C. 100V power supply and the trolley 34*b* has been closed. Thus the mutual relation between the timing for the switching of the alternating cam switches 37*a* and 37*b* and the timing for the switching of the pulse cam switches 40*a*, 40*b*, . . . 40*e*, are always random, so that it cannot be anticipated at all which one of the auto models 4*a*, 4*b*, . . . 4*e* will first arrive at the goal line 63. Therefore, even if the participant should repeat the play many times, he would not lose interest in the racing game, so that the present invention provides an extremely interesting racing game device.

In the preferred embodiment illustrated in the drawings and described above, the invention is described as an auto racing game device. However, it is quite immaterial whether the movable models are auto models, horse models, dog models, or the like. Therefore, obviously the present invention is applicable not only to auto racing but also equally applicable to horse racing, dog racing and the like.

While the present invention has been described above in connection with a preferred embodiment, the invention should not be limited to the illustrated embodiment only but various changes in design could be made without departing from the spirit of the invention.

What is claimed is:

1. A racing game device comprising a horizontal racing course plate, a plurality of racing elements on said racing course plate having magnets therein, a horizontally extending support table positioned beneath said racing course plate and having a central recess therein, a pair of parallel rails extending across said central recess, a traveling base frame mounted on said parallel rails for horizontal movement back and forth along said rails, a rotatable table pivotally mounted on said traveling base frame and a traveling motor fixedly mounted on said traveling base frame and having a single driving wheel driven thereby and engaged with and running along said support table for moving said traveling base frame and said rotatable table along said rails in one direction, then pivoting said rotatable table in a curvilinear movement around the one end of the parallel rails and then moving the traveling base frame and said rotatable table along said rails in the other direction, and finally pivoting said rotatable table in a curvilinear movement around the other ends of the parallel rails, whereby the rotatable table moves in a path made up of straightaways and curves joining the straightaways, a plurality of magnet means, one corresponding to each receiving element, positioned side by side on said rotatable table in a direction transverse to the direction of said path and mounted on said rotatable table for movement back and forth on said table in the direction of said path and electric motor means coupled to said magnet means for randomly driving said magnet means in said movement.

2. A racing game device as claimed in claim 1 in which said electric motor means comprises a plurality of electric motors coupled to the respective magnet means and circuit means coupled to said electrical motors for supplying positive and negative electrical currents to said motors in a random pattern for moving said magnet means back and forth in a random pattern.

3. A racing game device as claimed in claim 2 in which said circuit means comprises means for driving said motors in the direction for bringing all of the magnet means, and hence all of the racing devices, to an aligned position transverse of the direction of said path when said circuit means is first energized, and thereafter supplying the positive and negative electrical currents to said motors in a random pattern.

4. A racing game device as claimed in claim 2 in which said circuit means comprises a plurality of sets of cam actuated switches and cams engaged with said switches for opening and closing them, and cam driving motors for driving said cams, said cam actuated switches being coupled for supplying a positive or negative current to the respective electric motors depending on the algebraic sum of the currents through the cams in the respective sets of cams.

5. A racing game device as claimed in claim 1 in which said traveling base frame has latch means thereon for latching said rotatable table to said traveling base frame during movement along the length of said rails, and means for releasing said latch means to permit pivotal movement of said rotatable table adjacent the ends of said rails.

6. A racing game device as claimed in claim 1 in which said traveling base frame has a pivot thereon on which said rotatable table is pivotally mounted, said pivot extending upwardly to adjacent the under surface of said racing course plate, and a rotatable element on the upper end of said pivot movable along the under surface of said racing course plate for supporting the central portion of said plate during movement of said traveling base frame.

* * * * *